US011174799B2

(12) United States Patent
Taylor et al.

(10) Patent No.: US 11,174,799 B2
(45) Date of Patent: Nov. 16, 2021

(54) INTEGRATED VDA HOUSING WITH ANTI-ROTATION FEATURE

(71) Applicant: Continental Automotive Systems, Inc., Auburn Hills, MI (US)

(72) Inventors: Donald Taylor, Chatham (CA); Giri Thommandram, Chatham (CA); Benjamin Nydam, Chatham (CA)

(73) Assignee: Vitesco Technologies USA, LLC, Auburn Hills, MI (US)

( * ) Notice: Subject to any disclaimer, the term of this patent is extended or adjusted under 35 U.S.C. 154(b) by 216 days.

(21) Appl. No.: 16/270,001

(22) Filed: Feb. 7, 2019

(65) Prior Publication Data

US 2019/0271270 A1 Sep. 5, 2019

Related U.S. Application Data

(60) Provisional application No. 62/638,648, filed on Mar. 5, 2018.

(51) Int. Cl.
*F02D 9/08* (2006.01)
*F02D 9/10* (2006.01)

(52) U.S. Cl.
CPC ..... *F02D 9/107* (2013.01)

(58) Field of Classification Search
CPC ..... F02D 9/1035; F02D 9/107; F02D 9/16
USPC ..... 123/337
See application file for complete search history.

(56) References Cited

U.S. PATENT DOCUMENTS 5,341,773 A * 8/1994 Schulte ..... F02D 9/105 123/184.61
5,878,715 A * 3/1999 Hernandez ..... F02D 9/02 123/184.61
5,988,131 A * 11/1999 Hernandez ..... F02D 9/1035 123/184.21

(Continued)

FOREIGN PATENT DOCUMENTS

CN 102844967 A 12/2012
CN 206532175 U 9/2017

(Continued)

OTHER PUBLICATIONS

Chinese Office Action dated May 31, 2021 for corresponding Chinese Patent Application No. 201910164215.X.

*Primary Examiner* — Logan M Kraft
*Assistant Examiner* — Anthony Donald Taylor, Jr.

(57) ABSTRACT

A throttle control assembly which includes a housing, an adapter integrally formed with the housing, an anti-rotation feature integrally formed with the housing and the adapter, and a scallop. The scallop substantially surrounds the anti-rotation feature, and the anti-rotation feature and the scallop are integrally formed with the housing and the adapter during a molding process, such as a metal injection molding process, or a casting process. A first groove is integrally formed as part of the adapter, a second groove is integrally formed as part of the housing, and a rib portion is disposed between the first groove and the second groove. A lower wall portion is integrally formed as part of the housing, such that the lower wall portion is adjacent the scallop. A portion of the scallop is integrally formed as part of the housing, and a portion of the scallop is integrally formed as part of the adapter.

14 Claims, 3 Drawing Sheets

(56) References Cited

U.S. PATENT DOCUMENTS

| | | | | |
|---|---|---|---|---|
| 6,364,287 | B1 * | 4/2002 | Rauch | F02D 9/1065 137/315.22 |
| 9,144,936 | B2 * | 9/2015 | Weldon | H02K 15/14 |
| 9,657,878 | B2 * | 5/2017 | Hartmann | F16L 37/0885 |
| 10,215,105 | B1 * | 2/2019 | Nydam | F02D 9/1035 |
| 2005/0017211 | A1 * | 1/2005 | Hannewald | F02D 11/10 251/304 |
| 2016/0377001 | A1 * | 12/2016 | Taylor | F02D 9/107 123/337 |
| 2018/0142823 | A1 * | 5/2018 | Zbiral | F16L 37/0885 |

FOREIGN PATENT DOCUMENTS

| | | | |
|---|---|---|---|
| CN | 107642418 | A | 1/2018 |
| CN | 107676184 | A | 2/2018 |
| WO | 2018025048 | A1 | 2/2018 |

* cited by examiner

INTEGRATED VDA HOUSING WITH ANTI-ROTATION FEATURE

CROSS-REFERENCE TO RELATED APPLICATIONS

This application claims the benefit of provisional application 62/638,648, filed Mar. 5, 2018. The disclosure of the above application is incorporated herein by reference.

FIELD OF THE INVENTION

The invention relates generally to an electronic throttle body having an integrally formed anti-rotation feature, where the anti-rotation feature is formed during a molding or casting process, and without the use of any additional machining processes.

BACKGROUND OF THE INVENTION

Electronic throttle bodies are generally known, and it is typical for a duct or conduit to be connected to and in fluid communication with the throttle body for directing air into the throttle body, where the throttle body controls the flow of the air into an engine. The conduit is commonly connected to the throttle body through the use of a connector, and the conduit is prevented from rotating relative to the throttle body by some type of anti-rotation feature, which is engaged with the conduit.

Typical throttle bodies have parts which are made as a single component, but certain parts that are formed as part of the throttle body are more complex, and expensive to manufacture. Some of the parts of the throttle body are formed using a casting process, and others are formed using various machining processes. Additional machining processes increase cost, and require additional steps during manufacturing. Some throttle bodies have an anti-rotation feature which is formed during subsequent manufacturing processes, such as machining, or the anti-rotation feature is formed as part of one of several separate components of the throttle assembly, which are assembled together. The use of the subsequent manufacturing processes, or manufacture of several components, increases costs, manufacturing time, and increases the overall complexity of manufacturing the throttle body assembly. Furthermore, throttle body assemblies made of several components assembled together are typically unable to meet stringent packaging requirements.

Accordingly, there exists a need for a throttle body which is simpler to manufacture, and includes an anti-rotation feature that is formed without the use of additional machining processes.

SUMMARY OF THE INVENTION

In one embodiment, the present invention is a throttle control assembly which includes a housing, an adapter integrally formed with the housing, an anti-rotation feature integrally formed with the housing and the adapter, and a scallop. The scallop substantially surrounds the anti-rotation feature, and the anti-rotation feature and the scallop are integrally formed with the housing and the adapter during a molding process.

In an embodiment, a housing portion is part of the adapter, and the throttle control assembly includes a central port. Part of the central port extends through the housing portion of the adapter, and part of the central port extends through the housing.

A first groove is integrally formed as part of the adapter, a second groove is integrally formed as part of the housing, and a rib portion is disposed between the first groove and the second groove. The rib portion is formed as part of the adapter, the first groove and the rib portion substantially circumscribe the adapter, and the second groove partially circumscribes the housing.

In an embodiment, a lower wall portion is integrally formed as part of the housing, such that the lower wall portion is adjacent the scallop, and the second groove terminates into the lower wall portion.

A first end of the first groove is adjacent a portion of the scallop, and a second end of the first groove is adjacent a portion of the scallop.

In an embodiment, a portion of the scallop is integrally formed as part of the housing, and a portion of the scallop is integrally formed as part of the adapter.

The anti-rotation feature may be formed using one of several processes. In one embodiment, the scallop is integrally formed with the housing and the adapter during a casting process. In another embodiment, the scallop is integrally formed with the housing and the adapter during a metal injection molding process.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
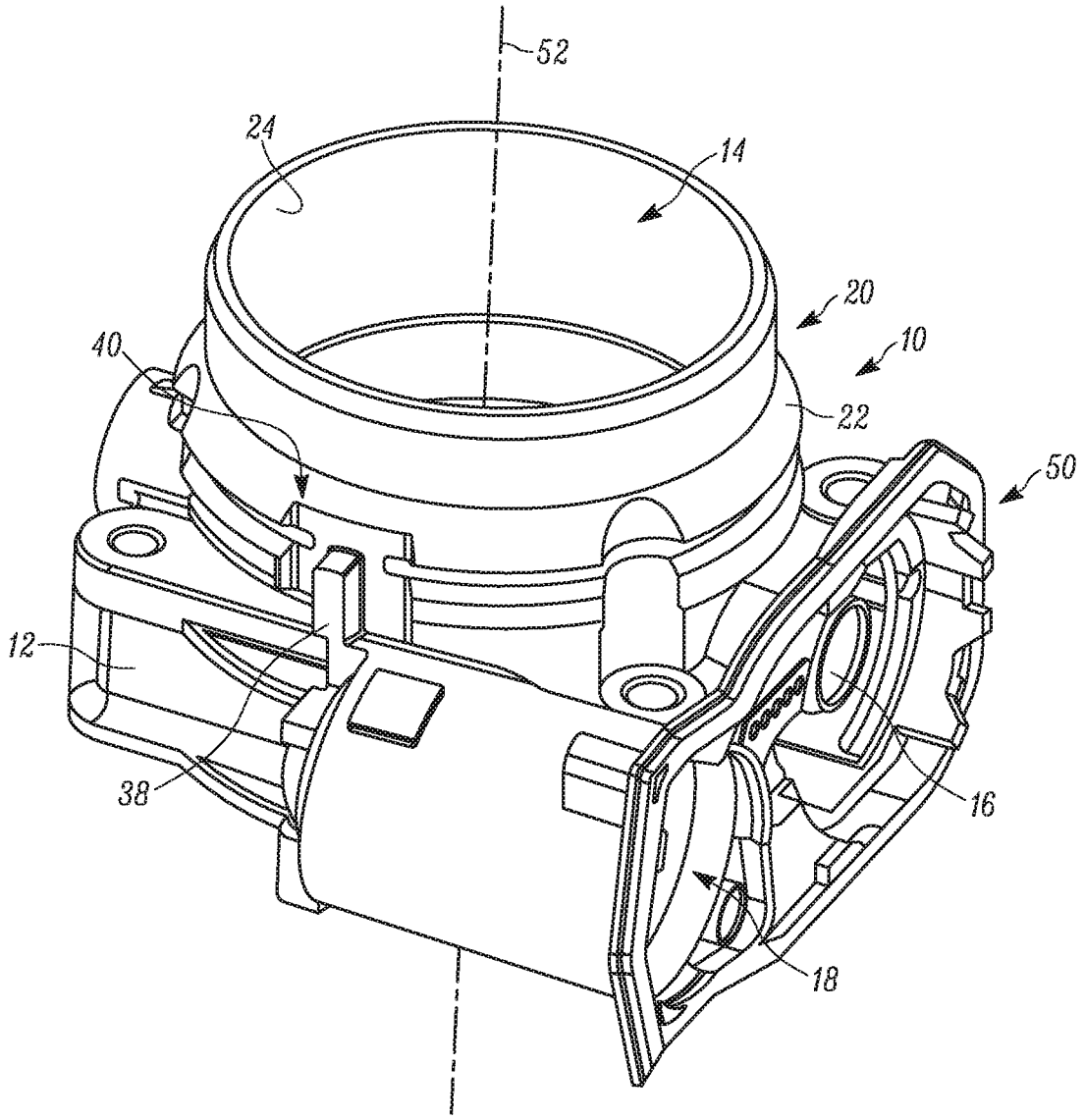
FIG. 1 is a perspective view of an electronic throttle body having an anti-rotation feature, according to embodiments of the present invention.
Figure 2:
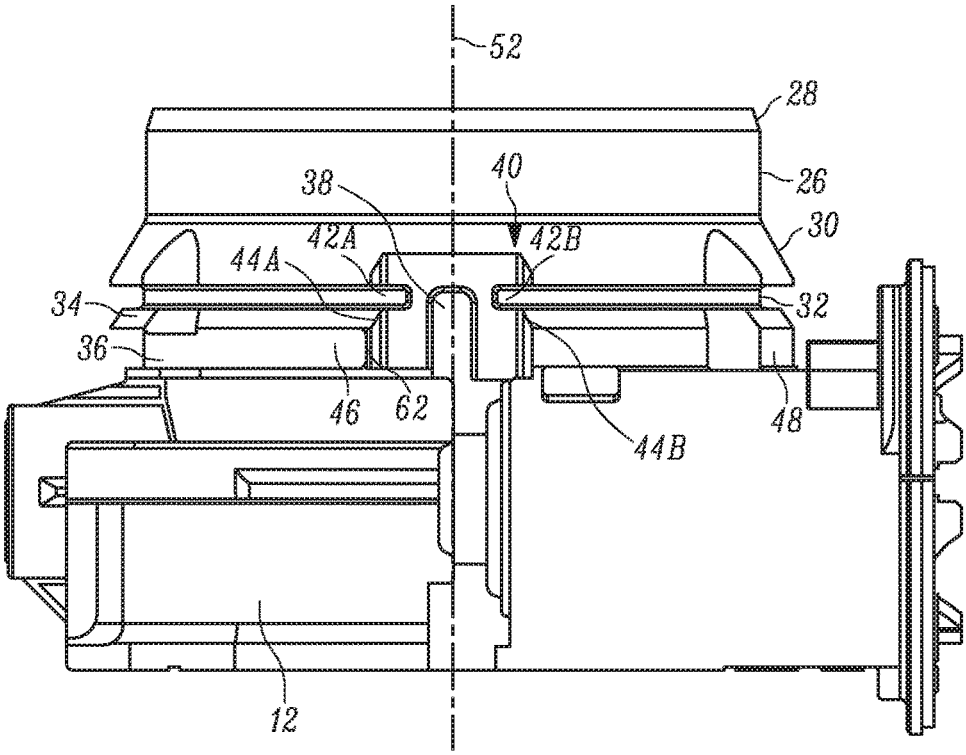
FIG. 2 is a front view of an electronic throttle body having an anti-rotation feature, according to embodiments of the present invention.
Figure 3:
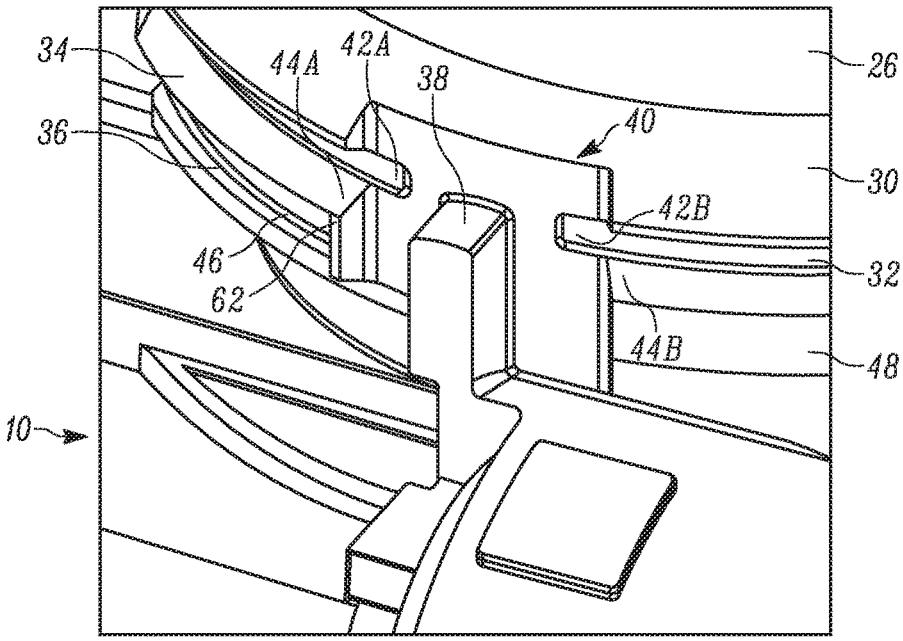
FIG. 3 is an enlarged perspective view of a portion of an electronic throttle body having an anti-rotation feature, according to embodiments of the present invention.
Figure 4:
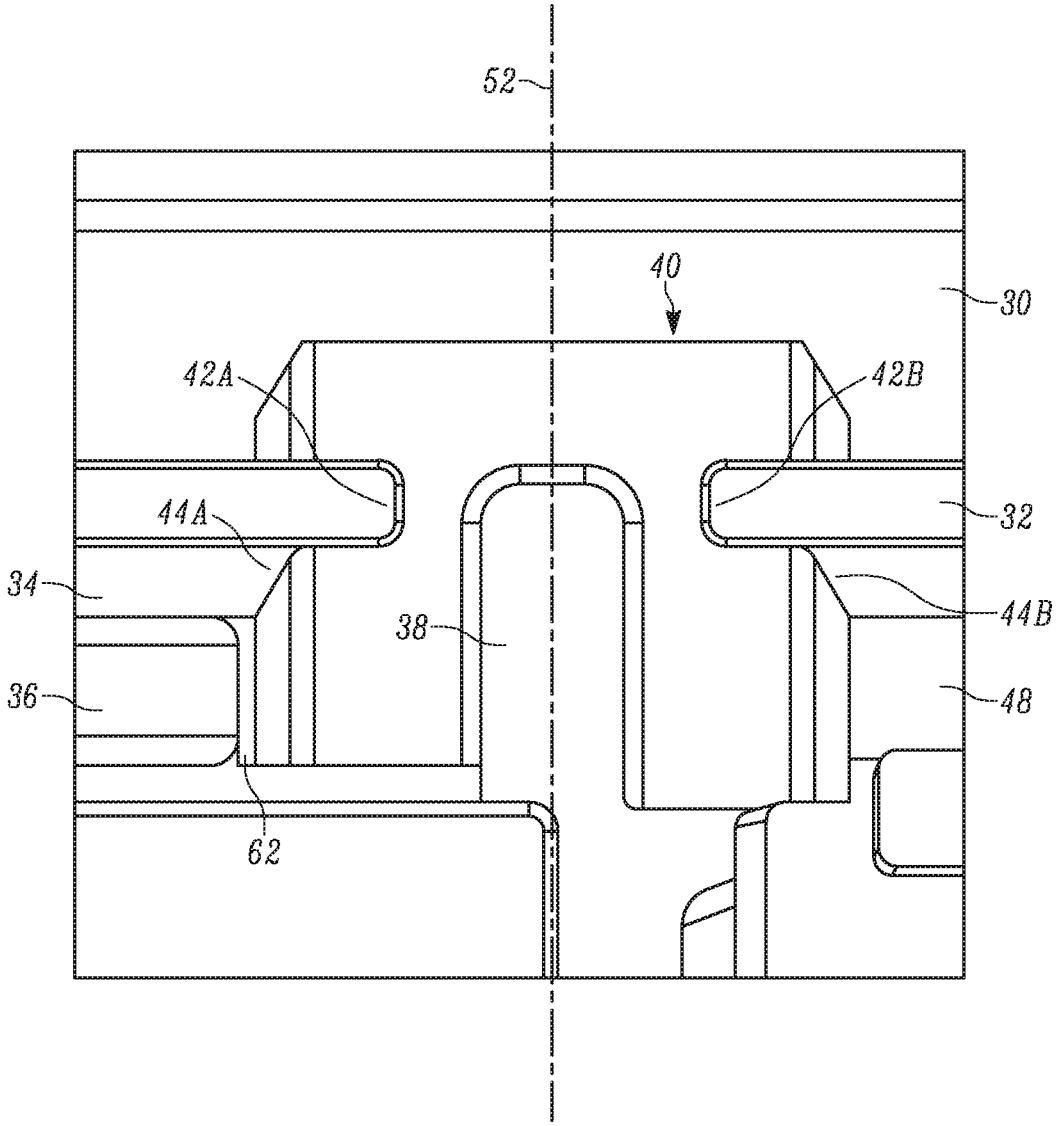
FIG. 4 is an enlarged front view of a portion of an electronic throttle body having an anti-rotation feature, according to embodiments of the present invention.

The following description of the preferred embodiment(s) is merely exemplary in nature and is in no way intended to limit the invention, its application, or uses.

An electronic throttle control assembly having an integrally formed anti-rotation feature according to the present invention in shown in the Figures generally at 10. The assembly 10 includes a throttle body housing 12, and formed as part of the housing 12 is a central port, shown generally at 14, through which air passes during operation of the assembly 10. There is a shaft (not shown) which extends through part of the central port 14, where the shaft is rotatable, and mounted to the shaft is a valve plate (also not shown).

The shaft is mounted in a bore 16 formed as part of the housing 12. The housing 12 also includes a cavity, shown generally at 18, and disposed in the cavity 18 is an actuator (not shown). The actuator is used for controlling a gear assembly, which is then connected to the shaft, thereby controlling the position of the valve plate in the central port 14. Changing the position of the valve plate controls the flow of air through the central port 14.

The assembly 10 also includes an adapter, shown generally at 20, where the adapter 20 is suitable for connection with a conduit. The adapter 20 includes a housing portion 22, and formed as part of the housing portion 22 is an aperture 24, which forms part of the central port 14, and is of a substantially constant inner diameter. The remaining part of the central port 14 is formed as part of and extends through the housing 12. The housing portion 22 also includes a first diameter portion 26 which is adjacent a first tapered portion 28. The housing portion 22 also has a second tapered portion 30 which is adjacent the first diameter portion 26. Each of the tapered portions 28,30 facilitate the connection between a conduit and the throttle control assembly 10.

Adjacent the second tapered portion 30 is a first groove 32, adjacent the first groove 32 is a rib portion 34, and adjacent the rib portion 34 is a second groove 36. Integrally formed with the housing 12 and the adapter 20 is an anti-rotation feature 38, which protrudes from the housing 12, and is adjacent the housing portion 22.

During assembly, the housing portion 22 is inserted into an end portion of the conduit, and the tapered portions 28,30 and anti-rotation feature 38 provide proper alignment between the housing portion 22 and the conduit during the assembly process at the facility where the throttle control assembly 10 is manufactured.

Integrally formed with the housing 12 and the adapter 20 is a scallop, shown generally at 40. Part of the scallop 40 is adjacent a first end 42A of the first groove 32, and a first end 44A of the rib portion 34. Part of the scallop is also adjacent a second end 42B of the first groove 32, and a second end 44B of the rib portion 34. An end portion 46 of the second groove 36 also terminates into a lower wall 62, which is adjacent a portion of the scallop 40. The grooves 32,36 and rib portion 34 are also used for connecting the conduit to the assembly 10. The grooves 32,36 are able to receive a snap ring, clip, or some other type of connecting device for securing the conduit to the assembly 10.

The throttle control assembly 10 is formed using various manufacturing processes. The housing 12, second groove 36, anti-rotation feature 38, and scallop 40 are formed during a casting process.

Once the casting process is complete, various portions of the throttle control assembly 10 have yet to be formed. A machining process is then used to form the housing portion 22, the first groove 32, and the rib portion 34. The scallop 40 provides adequate space which allows for various tooling to be used as part of the machining process to form the housing portion 22, the first groove 32, and the rib portion 34. The second groove 36 partially circumscribes the housing 12, and the first groove 32 and the rib portion 34 almost completely circumscribe the housing portion 22, with the exception of the areas occupied by the anti-rotation feature 38 and the scallop 40.

The second groove 36 (formed during the casting process) does not entirely circumscribe the housing 12. An outer portion 48 partially circumscribes the housing 12 in an area along the outside of the housing 12 (where the second groove 36 was not formed during the casting process), such that the outer portion 48 is adjacent a part of the rib portion 34 in a similar manner to the second groove 36. The outer portion 48 is formed during the machining process along with the housing portion 22, the first groove 32, and the rib portion 34. Part of the outer portion 48 extends along the outside of the housing 12 in an area where the portion having the cavity 18 is integrally formed with the housing 12. Another part of the outer portion 48 also extends along the outside of the housing 12 along an area where a gear housing 50 is integrally formed with the housing 12.

An axis 52 extends through the central port 14, and the anti-rotation feature 38 may be formed during the casting process at many possible locations along the outer surface of the housing 12.

The anti-rotation feature 38 being formed during the casting process, and the entire throttle control assembly 10 being formed as a single component, reduces the number of steps in the manufacturing process of the throttle control assembly 10, reducing manufacturing cost. Furthermore, during the casting process, the anti-rotation feature 38 may be formed along the line of draw within the die cast tool, such that the shape of the anti-rotation feature 38 does not have an effect on the removal of any tool inserts, tool sliders, or the separation of the mold components once the casting process is complete.

Furthermore, the dimensions of the anti-rotation feature 38 may be varied to be suitable for various packaging and design requirements, as well as different types of conduits having different connecting devices.

While it has been described above that the housing 12, second groove 36, anti-rotation feature 38, and scallop 40 are formed during a casting process, it is within the scope of the invention that these components may be formed during other types of processes as well, such as, but not limited to, metal injection molding and 3D printing.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a throttle control assembly, the throttle control assembly including:

a throttle body housing;

an adapter integrally formed with the throttle body housing;

an anti-rotation feature integrally formed with the throttle body housing and the adapter;

a scallop integrally formed with the throttle body housing and the adapter, the scallop substantially surrounding the anti-rotation feature;

a first groove integrally formed as part of the adapter;

a second groove integrally formed as part of the throttle body housing, and such that the second groove partially circumscribes the throttle body housing; and a rib portion disposed between the first groove and the second groove, the rib portion formed as part of the adapter, and such that the first groove and the rib portion substantially circumscribe the adapter.

2. The apparatus of claim 1, further comprising:

a housing portion of the adapter; and a central port;

wherein a first part of the central port extends through the housing portion of the adapter, and a second part of the central port extends through the throttle body housing.

3. The apparatus of claim 1, further comprising:

a wall portion integrally formed as part of the throttle body housing, such that the wall portion is adjacent the scallop, wherein the second groove terminates at the wall portion.

4. The apparatus of claim 1, wherein a first end of the first groove is adjacent the scallop.

5. The apparatus of claim 4, wherein a second end of the first groove is adjacent the scallop.

6. The apparatus of claim 1, wherein a first portion of the scallop is integrally formed as part of the throttle body housing, and a second portion of the scallop is integrally formed as part of the adapter.

7. The apparatus of claim 1, wherein the scallop is integrally formed with the throttle body housing and the adapter during a casting process.

8. The apparatus of claim 1, wherein the scallop is integrally formed with the throttle body housing and the adapter during a metal injection molding process.

9. A throttle control assembly, including:

a throttle body housing;

an adapter integrally formed with the throttle body housing;

an anti-rotation feature integrally formed with the throttle body housing and the adapter;

a scallop, wherein a first portion of the scallop is integrally formed as part of the throttle body housing, and a second portion of the scallop is integrally formed as part of the adapter, such that the scallop substantially surrounds the anti-rotation feature;

a first groove integrally formed as part of the adapter such that the first groove substantially circumscribes the adapter;

a second groove integrally formed as part of the throttle body housing such that the second groove partially circumscribes the throttle body housing;

a rib portion disposed between the first groove and the second groove, the rib portion formed as part of the adapter such that the rib portion substantially circumscribes the adapter; and a wall portion integrally formed as part of the throttle body housing, such that the wall portion is adjacent the scallop and the second groove terminates at the wall portion.

10. The throttle control assembly of claim 9, further comprising:

a housing portion of the adapter; and a central port;

wherein a first part of the central port extends through the housing portion of the adapter, and a second part of the central port extends through the throttle body housing.

11. The throttle control assembly of claim 9, wherein a first end of the first groove is adjacent the scallop.

12. The throttle control assembly of claim 11, wherein a second end of the first groove is adjacent the scallop.

13. The throttle control assembly of claim 9, wherein the scallop is integrally formed with the throttle body housing and the adapter during a casting process.

14. The throttle control assembly of claim 9, wherein the scallop is integrally formed with the throttle body housing and the adapter during a metal injection molding process.

* * * * *